US008009845B2

(12) United States Patent
Sakurai et al.

(10) Patent No.: US 8,009,845 B2
(45) Date of Patent: Aug. 30, 2011

(54) MICROPHONE APPARATUS

(75) Inventors: Kazuo Sakurai, Tokyo-to (JP); Masayuki Shimada, Saitama-ken (JP)

(73) Assignee: Victor Company of Japan, Limited, Yokohama-shi, Kanagawa-ken (JP)

( * ) Notice: Subject to any disclaimer, the term of this patent is extended or adjusted under 35 U.S.C. 154(b) by 800 days.

(21) Appl. No.: 12/083,909

(22) PCT Filed: Jul. 4, 2007

(86) PCT No.: PCT/JP2007/063345

§ 371 (c)(1),
(2), (4) Date: Apr. 21, 2008

(87) PCT Pub. No.: WO2008/004568

PCT Pub. Date: Jan. 10, 2008

(65) Prior Publication Data

US 2009/0046882 A1 Feb. 19, 2009

(30) Foreign Application Priority Data

Jul. 4, 2006 (JP) ..... P2006-184223

(51) Int. Cl.
*H04R 25/00* (2006.01)
*H04R 1/00* (2006.01)

(52) U.S. Cl. ..... 381/186; 381/335; 381/342; 381/355; 381/359; 381/385; 381/398; 381/399

(58) Field of Classification Search ..... 381/186, 381/335, 342, 355, 359, 385, 398, 399
See application file for complete search history.

(56) References Cited

U.S. PATENT DOCUMENTS

2005/0089188 A1* 4/2005 Feng ..... 381/396

FOREIGN PATENT DOCUMENTS

| | | | |
|---|---|---|---|
| JP | 55-073195 | A | 6/1980 |
| JP | 05-18188 | U | 3/1993 |
| JP | 06-73991 | U | 10/1994 |

* cited by examiner

*Primary Examiner* — Long Tran
(74) *Attorney, Agent, or Firm* — The Nath Law Group; Jerald L. Meyer; Derek Richmond

(57) ABSTRACT

A microphone unit (1) has a first vibration plate. A support member (6) supports the microphone unit (1). A second vibration plate (5) is fixed to the support member (6) at a predetermined distance from the first vibration plate. An armoring body (2) covers the microphone unit (1), the support member (6) and the second vibration plate (5). A space surrounded by the support member (6), the first vibration plate and the second vibration plate (5) is a closed space (S1) with air kept therein.

6 Claims, 10 Drawing Sheets

MICROPHONE APPARATUS

The present invention relates to a microphone apparatus suitable for use in strong winds at a time of driving a two-wheel vehicle on a road, and especially to a microphone apparatus capable of considerably reducing noise such as wind noise without significantly lowering sensitivity of a microphone.

BACKGROUND ART

Structures as shown in FIGS. 1 and 2 are conventionally known in common as microphone apparatuses.

A microphone apparatus 100 shown in FIG. 1(A) has a microphone unit "M" mounted on a distal end of a handle "H" and a porous windshield "W" made of urethane foam or the like covering the microphone unit "M". As shown in an acoustic equivalent circuit in FIG. 1(B), the windshield "W" serves an acoustic function to be an acoustic resistance for the microphone unit "M". Accordingly, by changing the direction of wind with the windshield "W", the microphone apparatus 100 shown in FIG. 1(A) is capable of reducing the occurrence of noise due to the microphone unit "M" catching wind noise (wind force noise). Since the windshield "W" works as the acoustic resistance on the acoustic equivalent circuit as the above, reducing the noise to a large degree, however, means increasing the acoustic resistance, thereby relatively lowering sensitivity of a microphone. That is, the ratio of speech signal to noise (SN ratio) is unchanged.

A microphone apparatus 200 shown in FIG. 2 has a structure in which microphone units "M", "M" are mounted on both ends of a handle "H" and wired in an electrically reversed phase in order to reduce noise. For the microphone apparatus 200, there must be used two microphone units "M" each with exactly the same frequency characteristic and phase characteristic. If the frequency characteristics differ even slightly while the phase characteristics are identical, an electrical output includes a noise output by the difference in sensitivities of the two microphone units "M". If the phase characteristics differ while the frequency characteristics are identical, the electrical output includes a noise output by the difference in phases of the two microphone units "M".

Although the microphone apparatus 200 shown in FIG. 2 is superior in theory, there is a need to manufacture homogeneous microphone units "M" with no variations in characteristics, which brings high cost. When the microphone apparatus 200 is used in a narrow space that influences the frequency characteristic or phase characteristic of one of the two microphone units "M", the effect of noise reduction cannot be obtained.

FIG. 3 is a schematic cross sectional view of a microphone unit "M" with a common directional characteristic. The microphone unit "M" has a structure where sound waves are input from sound openings "So" provided on back and forth sides of an inner diaphragm "d" (upper and lower sides in FIG. 3). When sound waves with the same phase are input from two sound openings "So" to the diaphragm "d", a superior effect of noise reduction will be brought out. The microphone unit "M" also has a structure capable of reducing noise due to a sound pressure from the side of the microphone unit "M" as shown in an arrow. The effect of noise reduction is however not brought out for use in a narrow space that gives an acoustic influence to the two sound openings "So".

As shown in FIG. 4, in a typical noise distribution, low-frequency components account for most part, and the higher the frequency goes the more the attenuation occurs. The ordinate axis of FIG. 4 represents sound pressure, which is the level of noise, and the abscissa axis represents frequency. In order to recreate a noise distribution in a narrow space, the microphone unit "M" is actually arranged within a full-face type helmet 50 as shown in FIG. 5 so that a sound opening "So" faces the mouth of a wearer 60 of the helmet 50, and then wind is blown into the helmet 50 by a hair drier 70. Thus, a noise distribution shown in FIG. 6 is measured.

In FIG. 6, "A" represents a frequency characteristic of a measurement result with the microphone unit "M" alone, and "B" represents a frequency characteristic of a measurement result with the microphone unit "M" covered by a windshield made of urethane foam. From FIG. 6, it is understood that the windshield does not work effectively for wind noise.

Now, under an environment with large noise from outside, it is common to put the microphone unit "M" closer to a sound source such as mouth in order to prevent noise from inputting to the microphone unit "M". In this case, the volume of sound input to the microphone unit "M" becomes excessive, thereby generating a distortion of output. As a countermeasure, an amplifier is used in an electrical circuit to perform an appropriate correction of sensitivity or a large acoustic resistance is provided for preventing the distortion. This attenuates a speech signal and noise relatively, and consequently the SN ratio does not change at all.

Patent document 1 (Japanese Utility Model Laid Open H5-18188) discloses a wind noise preventing type microphone apparatus that has a cylindrical case with a bottom which houses a microphone unit held by a microphone holder made of an elastic material, and has a foamed body with a predetermined width, which is sandwiched between a protector with a sound opening at a center portion thereof and an equalizer with a sound opening at an eccentric position thereof, at a front side of the microphone unit.

Patent document 2 (Japanese Utility Model Laid Open H6-73991) discloses a wind noise preventing type microphone apparatus that has a case in which a microphone unit and a wind noise absorbing laminated body are provided, wherein the laminated body is formed of an acoustic resistance material and two sheets of nonporous hard material which sandwiches the acoustic resistance material therebetween, and each sheet has a small hole made at a position apart from the central part thereof.

According to the microphone apparatuses described in the patent documents 1 and 2, the effect of noise (wind noise) reduction can be obtained. However, the foamed body of the microphone apparatus described in patent document 1 works as an acoustic resistance and the acoustic resistance material in the microphone apparatus described in the patent document 2 works as an acoustic resistance. Accordingly, there is a defect that the speech signal input to the microphone unit attenuates in proportion to the effect of noise reduction and the sensitivity of the microphone unit is significantly reduced.

Both microphone apparatuses described in the patent documents 1 and 2 need a large number of configuration elements, and consequently lowering the cost of production is difficult and the process of manufacturing is complicated. Further, in order to adjust sensitivity corresponding to the kind of microphone unit, plural kinds of foamed bodies or acoustic resistance materials are needed, and the effect of noise reduction will be lost when the sensitivity of the microphone unit is increased by changing a foamed body or acoustic resistance material.

DISCLOSURE OF TEE INVENTION

The present invention is provided in view of the above situations, and the object of the present invention is to provide a microphone apparatus capable of reducing noise (wind noise) without significantly lowering the sensitivity of a microphone.

In order to solve the above-described conventional technical problem, the present invention provides a microphone apparatus comprising: a microphone unit (1) that has a first vibration plate (13) to vibrate in reception of a sound wave from outside and converts the vibration of the first vibration plate (13) to an electric signal; a support member (6) that supports the microphone unit (1); a second vibration plate (5) that is fixed to the support member (6) at a predetermined distance from the first vibration plate (13); and an armoring body (2) that covers the microphone unit (1), the support member (6) and the second vibration plate (5), wherein a space surrounded by the support member (6) the first vibration plate (13) and the second vibration plate (5) is a closed space (S1) with air kept therein.

Here, it is preferable that the second vibration plate (5) is fixed to the holder (6) in parallel with the first vibration plate (13).

It is preferable that the armoring body (2) is a porous microphone windshield capable of transmitting a sound wave.

It is preferable that the microphone windshield has a cavity (23) that houses the microphone unit (1), the holder (6) and the second vibration plate (5).

It is preferable that the second vibration plate (5) is in non-contact with the inside of the microphone windshield, which is the top of the cavity (23).

It is preferable that the microphone windshield is formed in a dome shape and the second vibration plate (5) is arranged at a position opposed to the top of the dome-shaped microphone windshield.

According to the microphone apparatus of the present invention, since the second vibration plate different from the first vibration plate of the microphone unit is provided and a closed space with a gas kept therein is formed between the first vibration plate and the second vibration plate, it is possible to reduce noise (wind noise) to be transmitted to the vibration plate of the microphone unit by the stiffness or the like of the second vibration plate, even for use in strong winds at a time of running by a two-wheel vehicle on a road. Further, since the vibration of the second vibration plate by receiving a sound wave from outside is transmitted to the first vibration plate within the microphone unit through the gas (air) within the closed space, it is possible to increase the SN ratio with reducing the noise without significantly lowering the sensitivity of a microphone.

Since there is provided the armoring body covering the microphone unit, the support member, and the second vibration plate, it is possible to protect the microphone unit and the second vibration plate from external force and to keep up a visual appearance.

Furthermore, when a porous microphone windshield capable of transmitting a sound wave is adopted for the armoring body, it is possible to lead wind, which blows at the side of the microphone windshield, along the surface of the microphone windshield to reduce the amount of wind flowing into the microphone windshield, thereby reducing the wind noise. When a cavity is provided inside the microphone windshield and the second vibration plate does not contact with the inside of the microphone windshield, the vibration of the microphone windshield is less transmitted to the second vibration plate and a sound wave generated from the sound source is transmitted to the second vibration plate in a good condition.

BEST MODE FOR CARRYING OUT THE INVENTION

First Embodiment

Figure 7:
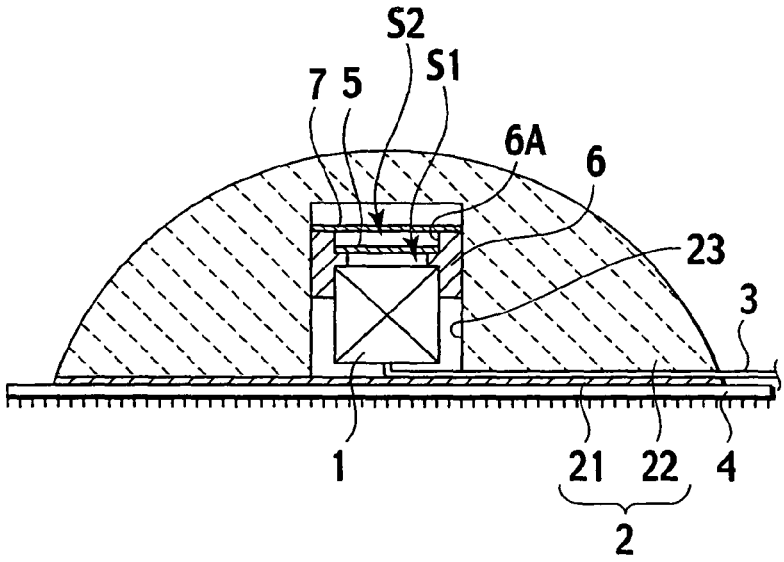
[FIG. 7] A cross-sectional view showing a microphone apparatus according to a first embodiment of the present invention.
Figure 8:
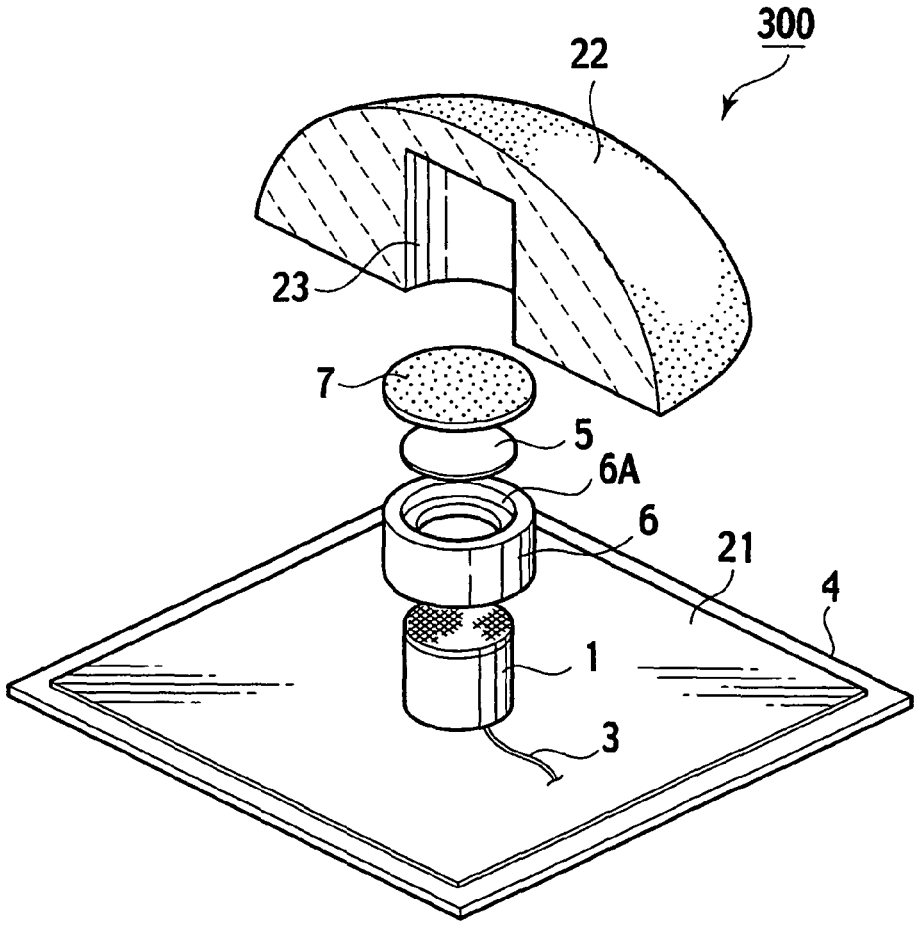
[FIG. 8] An exploded perspective view showing the microphone apparatus according to the first embodiment of the present invention.

With reference to figures, the present invention will be described in detail below. FIG. 7 is a cross-sectional view showing a microphone apparatus 300 according to the first embodiment of the present invention. FIG. 8 is an exploded perspective view of the microphone apparatus 300. In FIGS. 7 and 8, reference number 1 is a microphone unit that converts a sound wave to an electric signal. Reference number 2 is an armoring body that houses the microphone unit 1. The armoring body 2 comprises a bottom plate 21 having a flat plate shape and a microphone wind shield 22 having a domed shape firmly fixed on the bottom plate 21 by a pressure type adhesive. Between the bottom plate 21 and the microphone windshield 22, a signal line 3 with one end connected to the microphone unit 1 is got through.

The bottom plate 21 is a nonporous plate material that has a function to shut off an incident sound wave to the microphone unit 1. In the present embodiment, a resin plate (polyester film) having flexibility is used as the bottom plate 21.

At the bottom of the bottom plate 21 is provided a mounting sheet 4 for fixing the whole microphone apparatus 300 on an object such as a helmet. In the present embodiment, a surface fastener is used as the mounting sheet 4. It is possible to use a double-face adhesive tape instead of the surface fastener.

The microphone windshield 22 is a porous structural object with ventilation, which is, as a whole, capable of transmitting a sound wave. The microphone windshield 22 according to the present embodiment is made of a flexible urethane foam material and has a cavity 23 for housing the microphone unit 1 in the center thereof.

The microphone apparatus 300 has a structure where the microphone unit 1 is fixed on the bottom plate 21 by an adhesive or the like and the microphone unit 1 is covered with the microphone windshield 22. It is noted that instead of fixing the microphone unit 1 on the bottom plate 21, the microphone unit 1 may be supported from the side thereof by the microphone windshield 22 by making at least apart of an aperture diameter of the cavity 23 approximately the same as the outer diameter of the microphone unit 1. That is, the microphone unit 1 may be hold in a floating state by keeping away the microphone unit 1 from the bottom plate 21.

In the cavity 23 of the microphone windshield 22, there is provided a vibration plate 5 that opposes with a predetermined space to a diaphragm 13 (shown in FIG. 9) built-in at one end of the microphone unit 1. The diaphragm 13 of the microphone unit 1 is a first vibration plate and the vibration plate 5 is a second vibration plate. As described below, the space between the diaphragm 13 and the vibration plate 5 is a hermetically closed space where air for transmitting vibration is kept. The vibration plate 5 corresponds to a coupling condenser on an acoustic equivalent circuit, and a circular thin film made of plastic film, paper or the like which is low in mass is used as the vibration plate 5. In the present embodiment, the vibration plate 5 made of polyester film is provided at a position opposing to the top of the microphone windshield 22 and is not in contact with the inside of the microphone windshield 22.

Reference number 6 is a cylindrical supporting member to support the microphone unit 1. The supporting member 6 is attached to one end of the microphone unit 1 by a synthetic rubber adhesive or the like. The supporting member 6 is also fit to the cavity 23 and supported by the microphone windshield 22 from the side thereof. The supporting member 6 may be firmly fixed to the microphone windshield 22 by an adhesive or the like. The vibration plate 5 has its circumferential part fixed to a circular recess 6A of the supporting member 6 by the adhesive or the like. A space surrounded by the supporting member 6, the vibration plate 5 and the diaphragm 13 is a hermetically closed space S1 where air is kept. It is noted that the hermetically closed space Si may not be a completely hermetically closed type where the entrance and exit of gas (air) is completely prevented, but is preferable to be in a highly air-tight state.

The hermetically closed space S1 has a diameter (for example 6.0 mm) for example approximately the same as the diameter of a sound hole 11A (for example 5.8 mm) (shown in FIG. 9) of the microphone unit 1, and is made to allow the vibration of the vibration plate 5 in front and back directions (upper and lower directions in FIG. 7) within the range of diameter of the hermetically closed space S1. It is noted that the diameter of the hermetically closed space S1 may not be approximately the same as the diameter of the sound hole 11A. On the top of the supporting member 6 is stuck a protect sheet 7 made of a material with air permeability such as nonwoven fabric or the like. There is a predetermined space S2 between the vibration plate 5 and the protect sheet 7. The protect sheet 7 protects the vibration plate 5 from external force.

Figure 9:
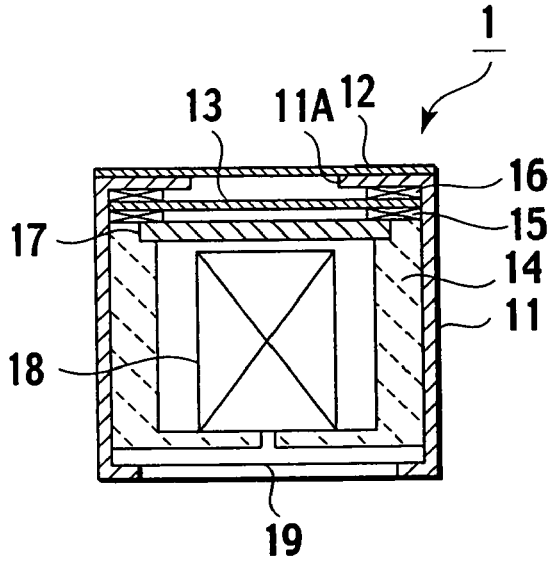
[FIG. 9] A cross-sectional view showing an example of a configuration of a microphone unit.

Here, the structure of the microphone unit 1 will be described using FIG. 9. In FIG. 9, reference number 11 is a cylindrical outer body and formed with the sound hole 11A at the center of one end thereof. On the top of the outer body 11, a cross 12 with air permeability is stuck to cover the sound hole 11A. In the outer body 11 are provided the diaphragm 13 that converts an incident sound wave from the sound hole 11A to machinery vibration, and a converting unit that converts the vibration of the diaphragm 13 to an electric signal. The diaphragm 13 is arranged via a spacer 15 on a resin holder 14 provided in the outer body 11. The spacer 15 and a ring-shaped gasket 16 support a circumferential part of the diaphragm 13.

The converting unit that converts the vibration of the diaphragm 13 to the electric signal is composed of a fixing polar plate 17 provided at the back of the diaphragm 13, an amplifier 18 connected to the fixing polar plate 17 and the like. The amplifier 18 is composed of, for example, a field-effect transistor (FET) and implemented on a circuit board 19 mounted at the bottom of the outer body 11.

According to the present embodiment, the microphone unit 1 is considered as a capacitor type (electrostatic type), but may be a dynamic type (electrodynamic type), piezoelectric type, carbon type, or the like.

According to the above configuration, when a user of the microphone apparatus 300 pronounces toward the microphone apparatus 300, a sound wave is transmitted to the vibration plate 5 through the windshield 22. Then, the vibration of the vibration plate 5 is transmitted to the diaphragm 13 in the microphone unit 1 through the air within the hermetically closed space S1. The microphone unit 1 converts the vibration of the diaphragm 13 to the electric signal and the electric signal is output from the signal line 3.

As a modification of the first embodiment, it may be as follows. The outer body 2 may only have an area, which is capable of transmitting a sound wave, at a side (top side of the microphone windshield 22) opposed to the hermetically closed space S1 with respect to the vibration plate 5. The area capable of transmitting a sound wave may therefore be an aperture as a sound path. Further, a porous plate, which is made of such as nonwoven fabric, metal wire, or the like, may be arranged on the aperture.

The microphone windshield 22 configuring the outer body 2 is not limited to the above flexible porous structure such as urethane foam as described above, but may be configured by a metal wire or metallic wind screen.

Second Embodiment

Figure 10:
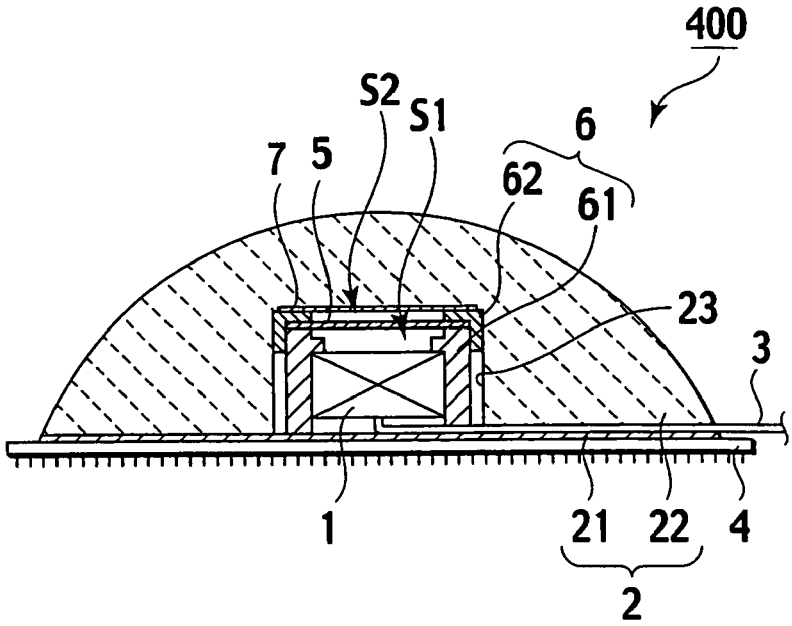
[FIG. 10] A cross-sectional view showing a microphone apparatus according to a second embodiment of the present invention.

In a microphone apparatus 400 according to the second embodiment shown in FIG. 10, the same numbers are assigned to common units with the microphone apparatus 300 according to the first embodiment, thereby, the detailed explanation is omitted. The modification of the first embodiment can be applied to the second embodiment.

In FIG. 10, the supporting member 6 is a two-pieces-structure composed of a cylindrical sleeve 61 and a circular holding frame 62 with an aperture at the center thereof. The holding frame 62 has a portion contacting with the top of the sleeve 61 and a portion extending a little to the back of the sleeve 61 to contact with an outer circumferential surface of the sleeve 61. In the microphone apparatus 400, the vibration plate 5 has its circumferential part sandwiched and fixed between the sleeve 61 and the holding frame 62. Though in FIG. 10, there is formed a space between a side surface of the sleeve 61 and the windshield 22, the circumferential surface of the sleeve 61 may be closely attached to the windshield 22 by making the cavity 23 fit to the shape of the supporting member 6.

In the microphone apparatus 400 according to the second embodiment, a space surrounded by the supporting member 6 (sleeve 61), the vibration plate 5 and the diaphragm 13 of the microphone unit 1 is the hermetically closed space S1 where air is kept. The vibration of the vibration plate 5 is transmitted to the diaphragm 13 through the air within the hermetically closed space S1.

Third Embodiment

Figure 11:
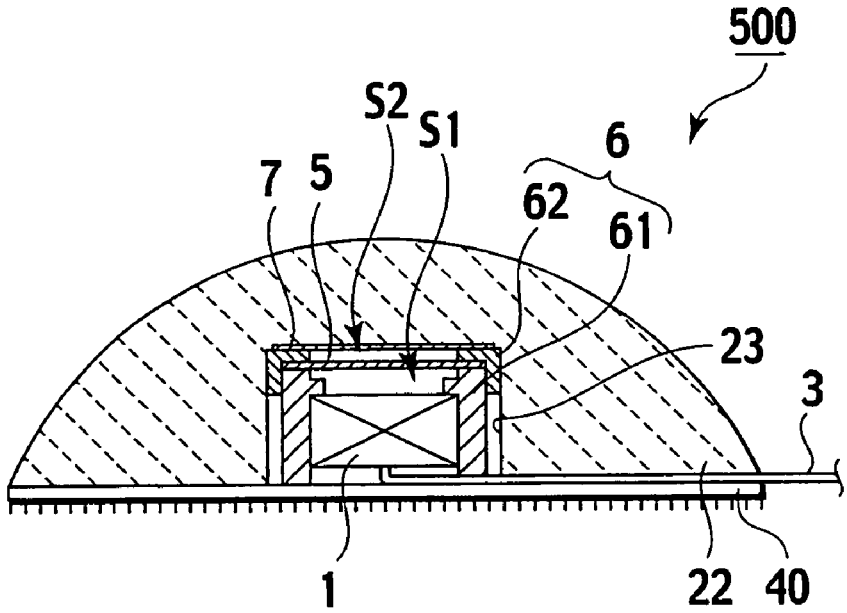
[FIG. 11] A cross-sectional view showing a microphone apparatus according to a third embodiment of the present invention.

In a microphone apparatus 500 according to the third embodiment shown in FIG. 11, the same numbers are assigned to common units with the microphone apparatus 400 according to the second embodiment, thereby, the detailed explanation is omitted. The modification of the first embodiment can be similarly applied also to the third embodiment.

In FIG. 11, the microphone apparatus 500 according to the third embodiment has a simplified structure where the bottom plate 21 of the microphone apparatus 400 is removed, thereby reducing cost. The microphone apparatus 400 has the mounting sheet 4 that is square-shaped and larger than the bottom surface of the microphone windshield 22. The microphone apparatus 500 however has a mounting sheet 40 that is circular shaped and approximately the same size with the bottom surface of the microphone windshield 22. This makes the mounting sheet 40 unlikely to come off from the bottom surface of the microphone windshield 22.

In the microphone apparatus 500, the microphone unit 1 is fixed to the mounting sheet 40 by the adhesive or the like. To the microphone unit 1 are mounted the sleeve 61, the vibration plate 5, the holding frame 62, and the protect sheet 7 in this order. The microphone windshield 22 is fixed to the mounting sheet 40 by the adhesive or the like and covers the whole from the microphone unit 1 to the protect sheet 7.

In the third embodiment, there is shown a structure where the bottom plate 21 according to the second embodiment is removed and the mounting sheet 40 is used instead of the mounting sheet 4. It is also possible to have a structure where the bottom plate 21 according to the first embodiment in FIGS. 7 and 8 is removed and the mounting sheet 40 is used instead of the mounting sheet 4.

Fourth Embodiment

Figure 12:
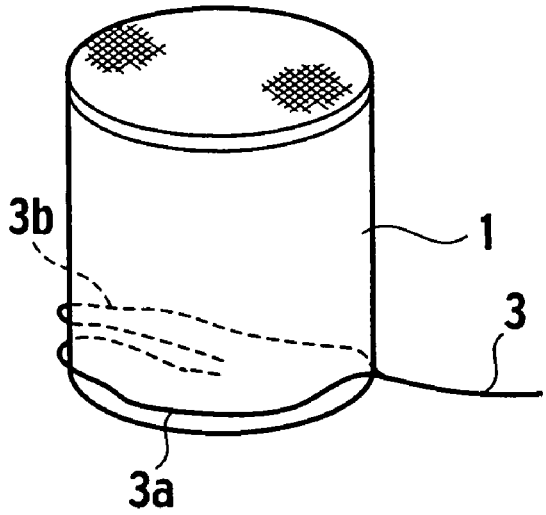
[FIG. 12] A cross-sectional view showing a microphone unit of a microphone apparatus according to a forth embodiment of the present invention.

The fourth embodiment is a modification that a method of pulling out the signal line 3 from the microphone unit 1 is improved. Except for the method of pulling out the signal line 3, there is used a structure according either one of the first to third embodiments. In FIG. 12 showing the fourth embodiment, thus, only the microphone unit 1 and the signal line 3 are illustrated.

In the first to third embodiments, the signal line 3 is pulled out from the bottom of the microphone unit 1, while in the fourth embodiment the signal line is pulled out as follows. That is, as shown in FIG. 12, a plus signal line 3*a* and a minus signal line 3*b* are pulled out from an outer circumferential surface to the exterior of the microphone unit 1, are respectively led in opposite directions along the outer circumferential surface, and are bound to be the signal line 3. This improves the strength of tension of the signal line 3.

Fifth Embodiment

Figure 13:
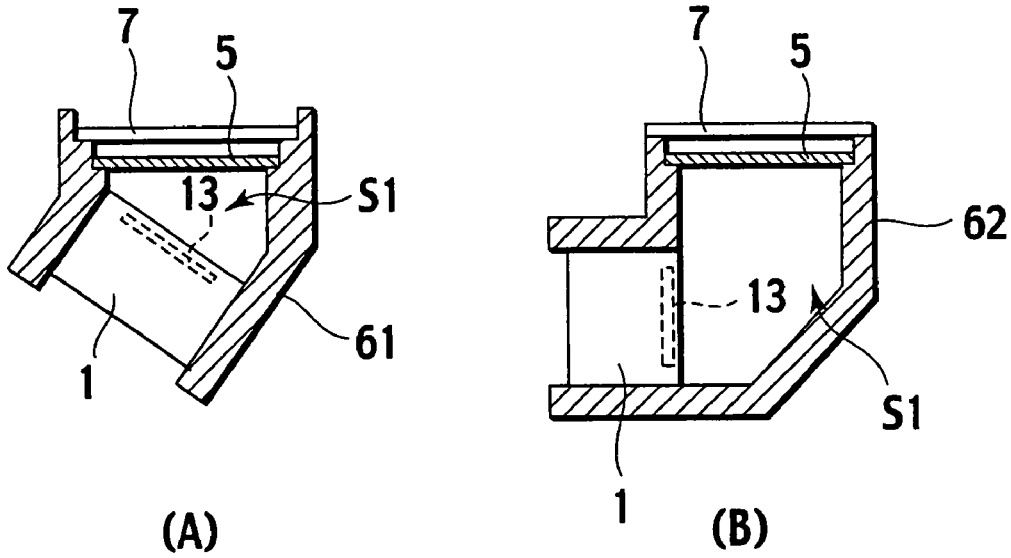
[FIG. 13] Cross-sectional views showing microphone units of a microphone apparatus according to a fifth embodiment of the present invention.

In the first to fourth embodiments, the vibration plate 5 is configured in parallel to the diaphragm 13. They may not however necessarily be in parallel. FIGS. 13(A) and (B) show the fifth embodiment where the vibration plates 5 and 13 are not in parallel. FIG. 13(A) is an example where the vibration plate 5 is fixed so that the vibration plate 5 is slightly inclined with respect to the diaphragm 13. In this case, the supporting member 61 is formed in an inflected tubular shape. The microphone unit 1 is fixed at one end side of the supporting member 61 within the supporting member 61, and the vibration plate 5 is fixed at the other end side of the supporting member 61. Between the vibration plate 5 and the diaphragm 13 is formed the hermetically closed space S1 where gas is kept.

FIG. 13(B) is an example where the vibration plate 5 is fixed so that the vibration plate 5 is perpendicular to the diaphragm 13. In this case, the supporting member 62 is tubular and flexed to a right angle. The microphone unit 1 is fixed at one end side of the supporting member 62 within the supporting member 62, and the vibration plate 5 is fixed at the other end side of the supporting member 62. Between the vibration plate 5 and the diaphragm 13 is formed the hermetically closed space S1 where the gas is kept.

Figure 14:
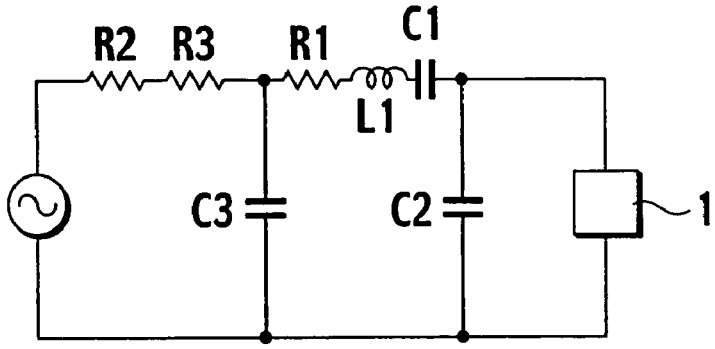
[FIG. 14] An acoustic equivalent circuit of the microphone apparatus according to each embodiment of the present invention.

FIG. 14 shows an acoustic equivalent circuit of the microphone apparatuses 300, 400, 500 according to the embodiments configured as the above. In FIG. 14, R1 is a mechanical resistance of the vibration plate 5, R2 is an acoustic resistance of the microphone windshield 22, R3 is an acoustic resistance of the protect sheet 7, C1 is a compliance of the vibration plate 5, C2 is an acoustic capacitance (of hermetically closed space S1) between the vibration plate 5 and the microphone unit 1, C3 is an acoustic capacitance (of hermetically closed space S2) between the vibration plate 5 and the protect sheet 7, and L1 is the mass of the vibration plate 5.

Here, when the mass L1 is large, a large resonance frequency is generated in an auditory area of the microphone characteristic. It is needed to make the mass L1 as small as possible by forming the vibration plate 5 with a lightweight material. When the mass L1 of the vibration plate 5 is made small, L1 in the acoustic equivalent circuit in FIG. 14 can be reduced to a negligible level and it is possible to make the vibration plate 5 work effectively as the coupling condenser.

Figure 15:
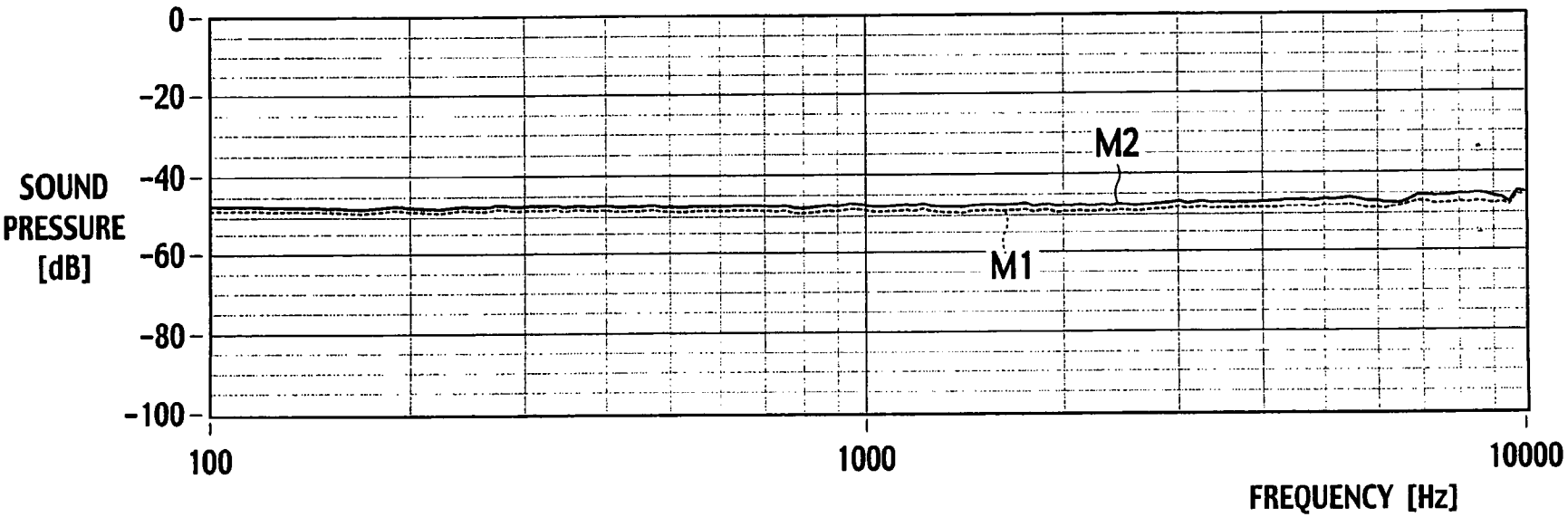
[FIG. 15] A frequency characteristic view of the microphone unit alone under no wind.

FIG. 15 shows a frequency characteristic of the microphone unit 1 alone measured in an anechoic chamber with no noise included under no wind. In FIG. 15, M1 is a frequency characteristic of the microphone unit 1 which is used for a prototype for the microphone apparatuses 300, 400, and 500, and M2 is a frequency characteristic of a microphone unit for comparison (microphone unit "M" used in the measurement in FIG. 5). It is admitted that M1 and M2 show almost the same frequency characteristic.

Figure 16:
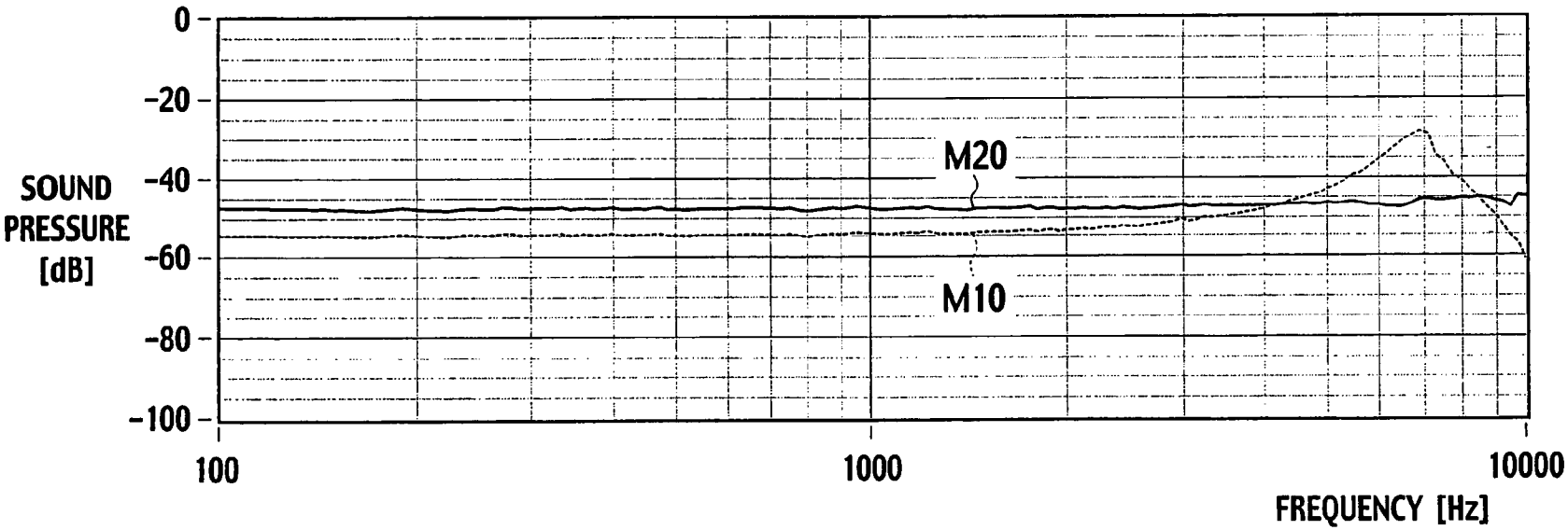
[FIG. 16] A frequency characteristic view of the microphone apparatus under no wind.

FIG. 16 shows a frequency characteristic of the microphone apparatus measured in an anechoic chamber with no noise included under no wind. In FIG. 16, M10 is a frequency characteristic of the microphone apparatuses 300, 400, and 500 using the microphone unit 1 with the frequency characteristic M1, and M20 is a frequency characteristic of a microphone apparatus (called microphone apparatus for comparison) which comprises the microphone unit "M" with the frequency characteristic M2 covered by only a windshield made of urethane which is similar to the microphone windshield 22. It is admitted that there is a difference in sensitivity by 6 dB until a frequency of about 2 kHz between the frequency characteristics M10 and M20. This is however due to an adjustment of mechanical impedance (stiffness and the like) of the vibration plate 5 in order to prevent a distortion generated by locating the microphone unit 1 at a mouth which is a sound source.

Figure 1:
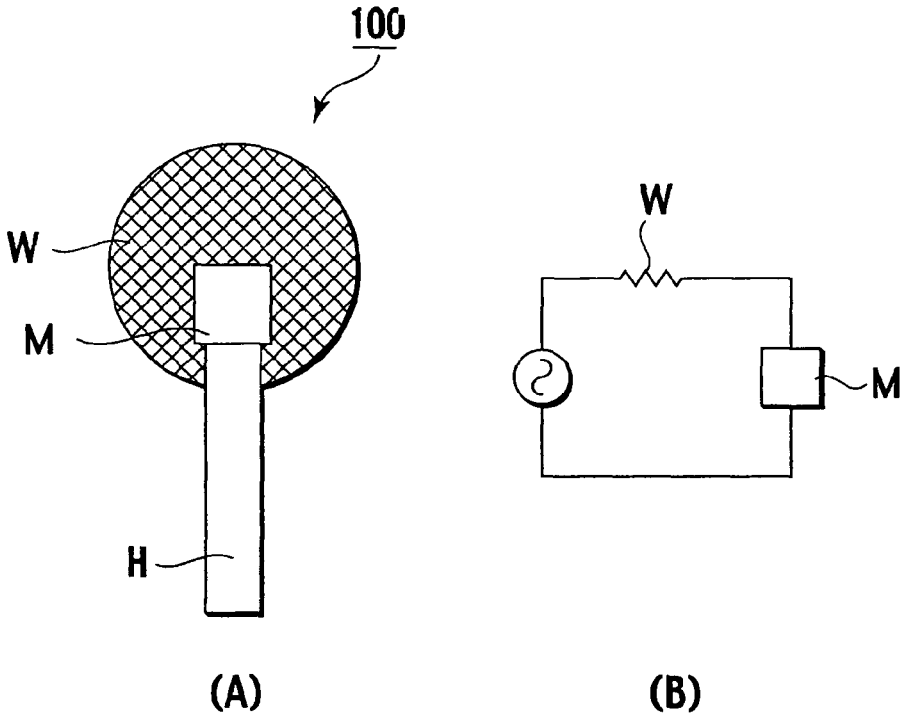
[FIG. 1] Explanatory views showing a conventional microphone apparatus and an acoustic equivalent circuit thereof.
Figure 2:
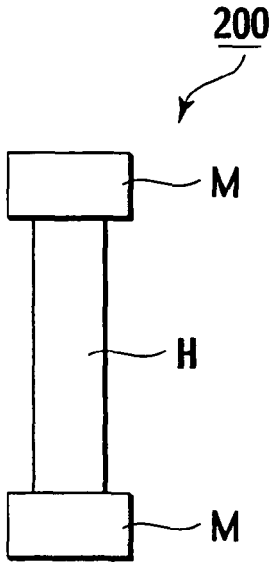
[FIG. 2] A schematic view of the other conventional microphone apparatus.
Figure 3:
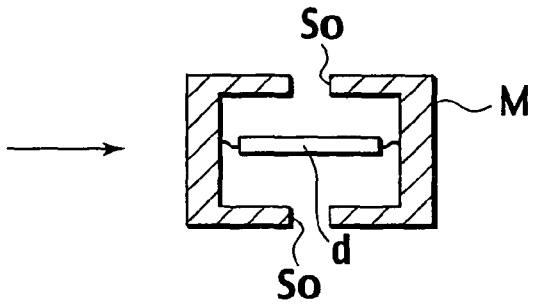
[FIG. 3] A schematic cross-sectional view of a microphone unit.
Figure 4:
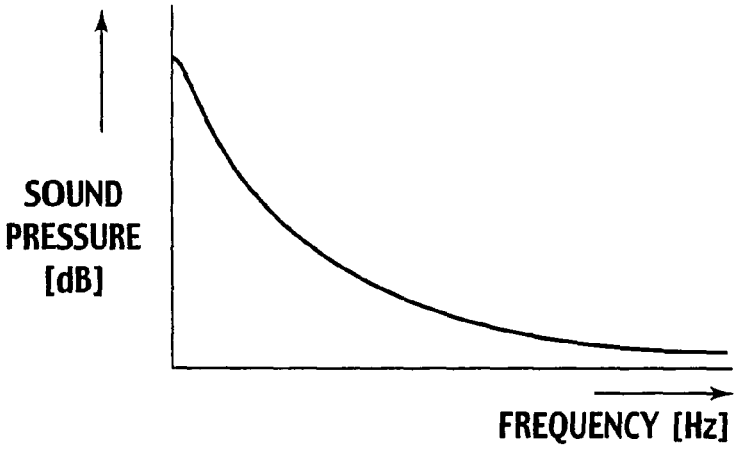
[FIG. 4] A characteristic view showing the relationship between noise and frequency.
Figure 5:
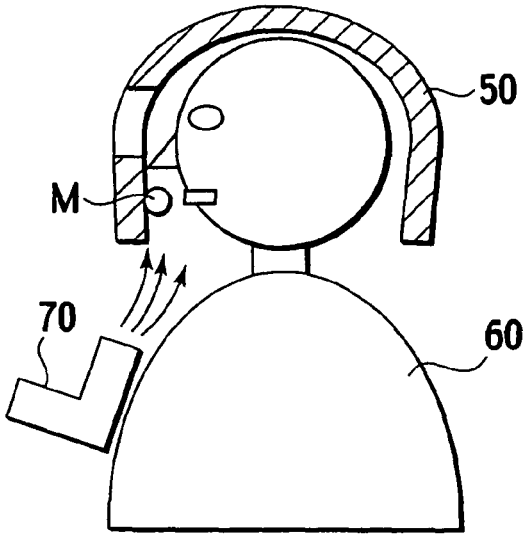
[FIG. 5] An explanatory view showing an example of a mounting position of the microphone unit in a measurement of noise distribution.
Figure 6:
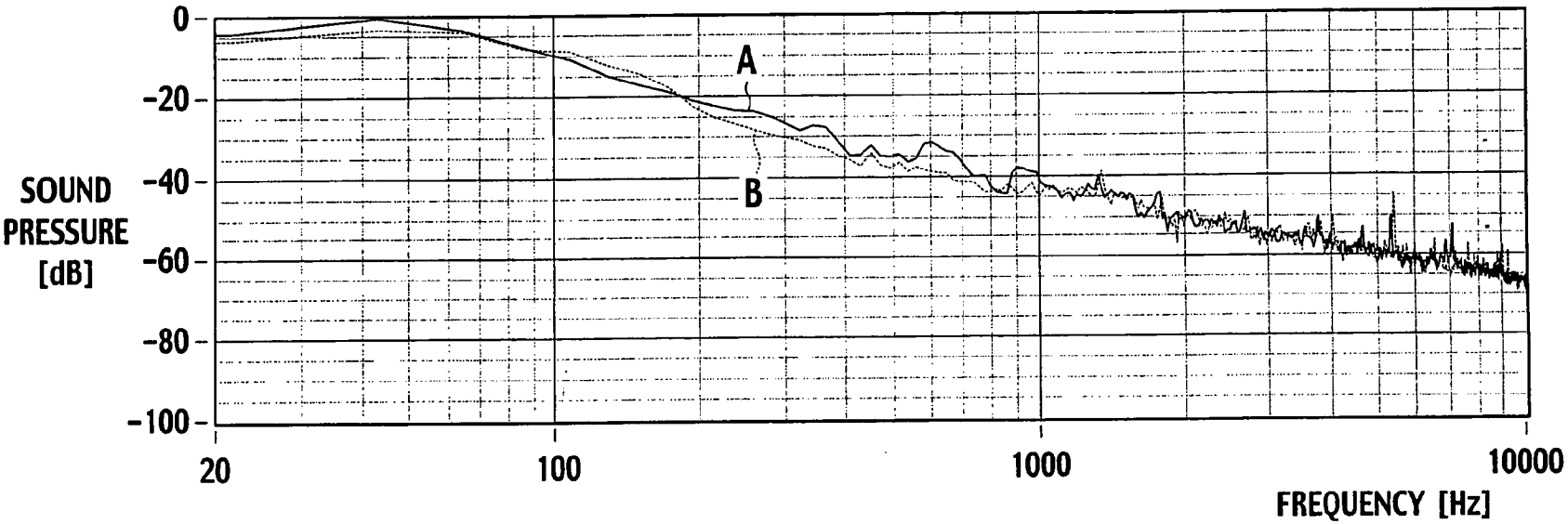
[FIG. 6] A frequency characteristic view in the measurement of noise distribution in the example of FIG. 5.
Figure 17:
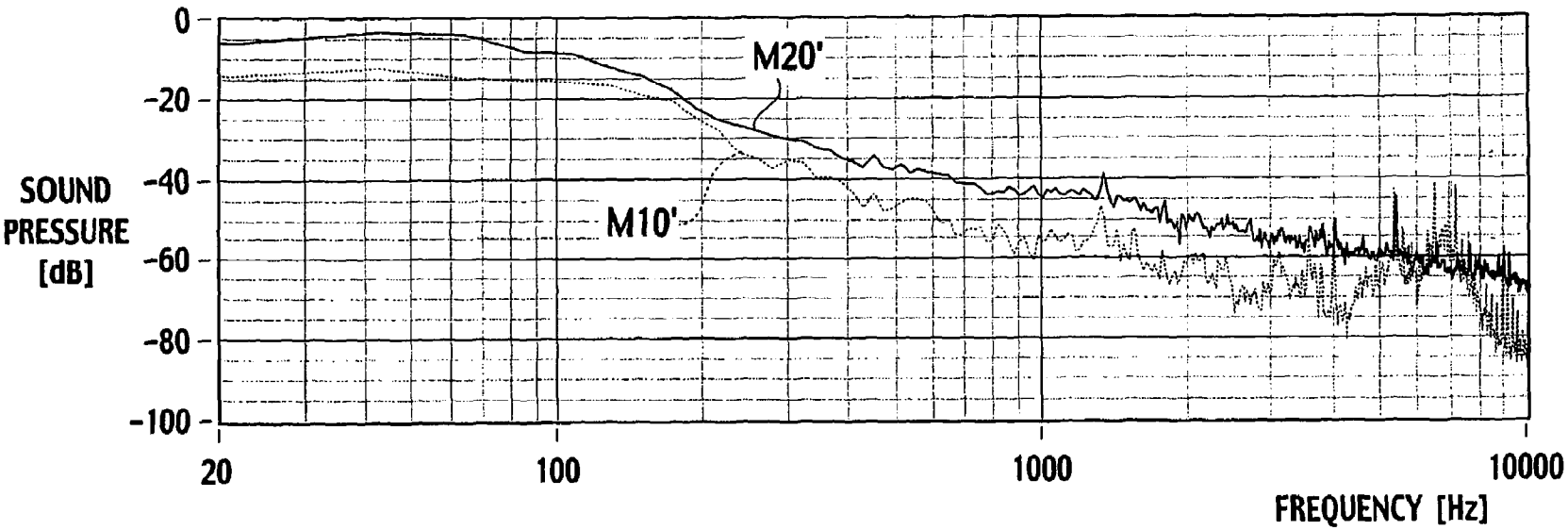
[FIG. 17] A frequency characteristic view of the microphone apparatus in strong winds.

FIG. 17 shows a frequency characteristic of the microphone apparatus in strong winds as well as in FIG. 5. In FIG. 17, M10' is a frequency characteristic of the microphone apparatuses 300, 400, and 500 in strong winds, and M20' is a frequency characteristic of the above microphone apparatus for comparison in strong winds. The frequency characteristic M20' is similar to the frequency characteristic B in FIG. 6. As is obvious from FIG. 17, it is admitted that the noise reduces in the microphone apparatuses 300, 400, and 500 according to the present embodiments by 20 dB at the maximum in the range of 20 Hz to 5 kHz, in comparison with the microphone apparatus for comparison which has only the windshield. It is noted that the noise reduces most at around 2.5 kHz.

In view of the difference in sensitivity explained in FIG. 16, it is recognized that the microphone apparatuses 300, 400, and 500 have the effect of noise reduction by 14 dB at the maximum, in comparison with the microphone apparatus for comparison. The difference in sensitivity of the frequency characteristics M10 and M20 in FIG. 16 and the difference in the frequency characteristic regarding noise in FIG. 17 are essentially the same in theory. However, as shown in FIG. 17, the noise of frequency characteristic M10' is reduced by more than the difference in sensitivity, in comparison with that of frequency characteristic M20'. This is due to the unique configurations of the microphone apparatuses 300, 400, and 500 that improve the SN ratio so as to give the effect of the noise reduction.

The microphone apparatuses 300, 400, and 500 according to the present embodiments are fixed, for example, to the inside of a helmet for two-wheel vehicle by the mounting sheet 4 or 40 and used as a transmitter in motion. The microphone apparatuses 300, 400, and 500 are capable of transmitting a speech signal with high quality and with less wind noise.

INDUSTRIAL APPLICABILITY

The microphone apparatus according to the present invention can be used not only in running on a road by two-wheel vehicle but in all environments in strong winds with large wind noise. The microphone apparatus according to the present invention can be also used in a normal environment other than in strong winds.

What is claimed is:

1. A microphone apparatus comprising:

a microphone unit that has a first vibration plate to vibrate in reception of a sound wave from outside and converts the vibration of the first vibration plate to an electric signal;

a support member that supports the microphone unit;

a second vibration plate that is fixed to the support member at a predetermined distance from the first vibration plate; and an armoring body that covers the microphone unit, the support member and the second vibration plate, wherein a space surrounded by the support member, the first vibration plate and the second vibration plate is a closed space with air kept therein.

2. The microphone apparatus according to claim 1, wherein the second vibration plate is fixed to the support member in parallel to the first vibration plate.

3. The microphone apparatus according to claim 1, wherein the armoring body is a microphone windshield that is porous and capable of transmitting a sound wave.

4. The microphone apparatus according to claim 3, wherein the microphone windshield has a cavity to house the microphone unit, the support member and the second vibration plate.

5. The microphone apparatus according to claim 4, wherein the second vibration plate is in non-contact with the inside of the microphone windshield which is the top of the cavity.

6. The microphone apparatus according to claim 4, wherein the microphone windshield is formed in a dome shape and the second vibration plate is provided at a position opposed to the top of the microphone windshield.

* * * * *